United States Patent [19]

Zema

[11] 4,287,803

[45] Sep. 8, 1981

[54] ELECTRIC MOUTH ORGAN HOLDER

[76] Inventor: Fred Zema, 26 Rosehill Ave., Tarrytown, N.Y. 10591

[21] Appl. No.: 53,069

[22] Filed: Jun. 28, 1979

[51] Int. Cl.[3] ..... G10H 1/04; G10H 3/12

[52] U.S. Cl. ..... 84/1.06; 84/1.24; 84/1.25; 84/379

[58] Field of Search ..... 84/1.04, 1.06, 1.14, 84/1.24, 1.25, 377, 378, 379, DIG. 14

[56] References Cited

U.S. PATENT DOCUMENTS 1,884,150 10/1932 Numberg ..... 84/379
1,954,169 4/1934 Futer ..... 84/379
2,664,775 1/1954 Zielinski ..... 84/1.04
2,945,408 7/1960 Terlinde ..... 84/1.04

*Primary Examiner*—Stanley J. Witkowski
*Attorney, Agent, or Firm*—Israel Nissenbaum

[57] ABSTRACT

An electric mouth organ holder containing a microphone therewithin and comprising an outer shell upon which are supported radially outwardly projecting harmonicas and a central core section rotatable with respect to said outer shell. The harmonicas are rotatably juxtaposed adjacent to said central core section as desired with individual harmonicas of different keys or types being thereby operatively associated with said microphone.

18 Claims, 17 Drawing Figures

ELECTRIC MOUTH ORGAN HOLDER

The present invention relates to electrically amplified harmonicas and more particularly to multiple electrically amplified harmonicas and holders for such harmonicas.

Harmonicas have, in the past, been generally utilized as single or individual instruments. The harmonica is held or cupped in the player's hands and manipulated to provide sound effects whether in conjunction with a microphone or not. However, harmonicas generally do not have the range of other musical instruments whereby a single harmonica may be utilized in playing several keys. Diatonic harmonicas which do not have sharps or flats and which are the most common type are specifically constructed for use in a single key. The more professional chromatic harmonicas having sharps and flats are also generally tuned for a single key though they are adaptable to be played in several keys. Though the chromatic harmonicas may be played in several keys, a tune learned in one key must be relearned in order that it may be played in another key. Furthermore, the playing of a key other than the tuned one on a chromatic harmonica requires greater physical abilities in draw and breath compared to those normally required. Despite the shortcomings of individual harmonicas the use of multiple harmonicas of various keys in a unitary structure has been generally eschewed since the use of individual harmonicas provides for great flexibility in sound control and amplification. The utilization of harmonica holders whereby individual harmonicas may be extracted as required, additionally engenders a problem of lost beats during the interchange of harmonicas within a single song. Accordingly such holders are generally utilized for holding harmonicas for use in different songs which are to be played in different keys.

It is an object of the present invention to provide an electric mouth organ holder for containing harmonicas of various keys or types whereby the harmonicas may be individually associated with a microphone for amplification thereafter.

It is a further object of the present invention to provide an electric mouth organ holder for containing harmonicas of various keys or types whereby sound therefrom may be controlled or altered to provide various sound effects.

These and other objects, features and advantages of the present invention will be more clearly seen from the following description as well as the drawings in which.

Figure 1:
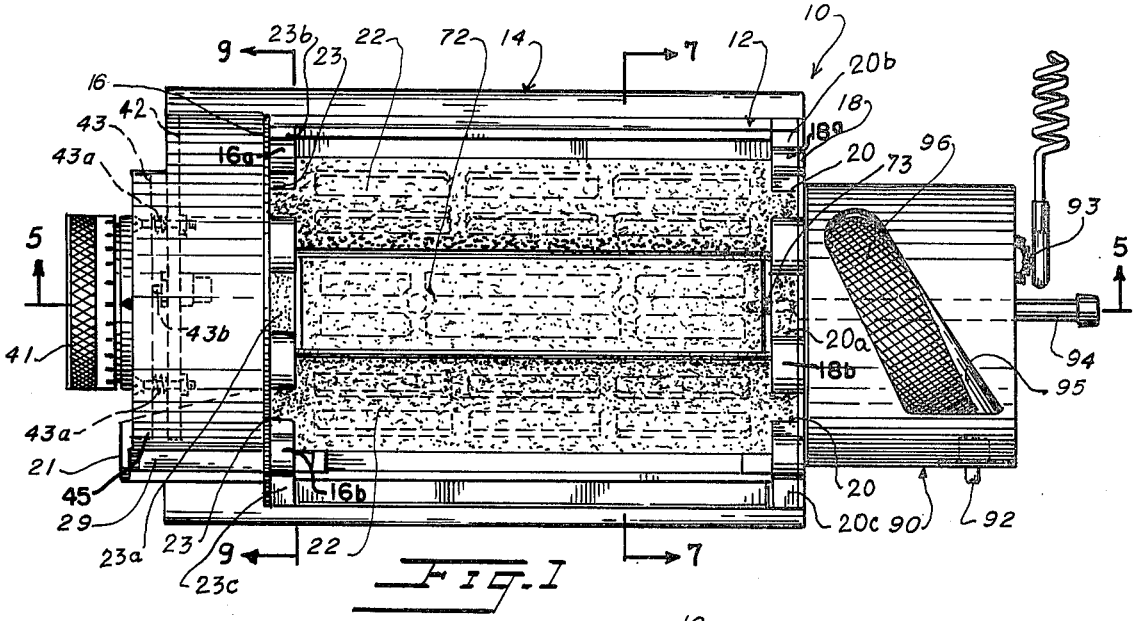
FIG. 1 is a top plan view of an embodiment of a mouth organ holder of the present invention with harmonicas removed for clarity.

In general the present invention comprises an electric mouth organ holder having a unitary structure containing a microphone therein and harmonica holding means thereon for supporting two or more harmonicas. The unitary structure comprises two components in movable relation to each other whereby harmonicas held by said holding means may be individually moved into operative sound association with said microphone for amplification. The first of said components includes said holding means and supports and holds harmonicas in a radially projecting outward direction and the second of said components either directly contains said microphone for adjacent sound coupling with the individual harmonicas or said second component contains sound collecting and/or sound channeling means between the individual harmonicas and the microphone. In such second embodiment sound emitted from the harmonicas may be modified to provide various sound effects prior to the sound reaching the microphone.

The harmonicas used in the electric mouth organ holder are generally standard harmonicas of various keys or types whereby different harmonicas may be quickly utilized as desired or required.

Structurally, the preferred embodiment of the electric mouth organ holder comprises an outer generally cylindrical shell or framework with a portion therof being open for the introduction of sound from associated harmonicas to the interior of said shell. The harmonicas are supported and held on the shell by disengageable holding means on the shell such that the harmonicas radially project outwardly with their respective bases facing the open portion of the shell and the mouthpieces facing outwardly.

Within said outer shell is a longitudinally disposed central core section. The central core section extends axially throughout the length of the outer shell and through apertures in the end walls of the outer shell. The central core section is circular at the apertures whereby it is rotatable relative to said outer shell. With such rotation the harmonicas held on the outer shell may be individually juxtaposed adjacent the central core section as desired. The central core section comprises a sound collector having a generally cylindrical configuration with an open portion thereof adapted for close proximity with the base of a harmonica held on the outer shell. Said sound collector is supported by a base support therefor on the central core section whereby it can be rotated for proper juxtaposition with a desired harmonica. The collected sound is directed to a sound control chamber whereby the sound is modified to produce various sound effects and thereafter the sound is directed to a microphone for amplification.

The sound control chamber and the microphone are preferably located at the ends of or at one end of the outer shell. The sound control chamber has a generally hollow cylindrical configuration with an aperture therein for finger control. Other sound control means include volume control for the microphone and a phaser or a leslie control directly associated with an amplifier. Amplification of the sound provides for other possible sound effects such as equalizers and the like which are directly associated with the amplifiers and the controls of which may also be included in the holder structure. In another embodiment the central core section contains or holds the microphone whereby the microphone itself may be brought into direct proximity with the desired harmonica. Such embodiment provides a more open and truer sound because of the proximity of harmonica to microphone however sound effect manipulation is curtailed therewith.

Figure 2:
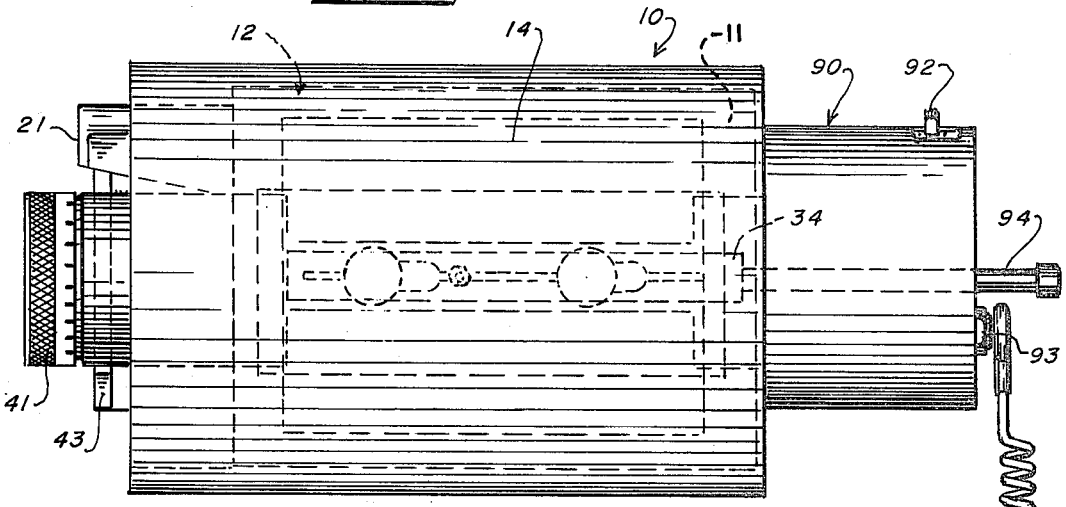
FIG. 2 is a bottom plan view of the mouth organ holder.
Figure 3:
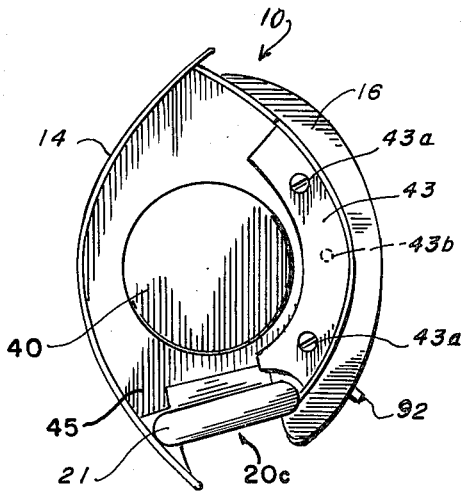
FIG. 3 is a left end view thereof.
Figure 4:
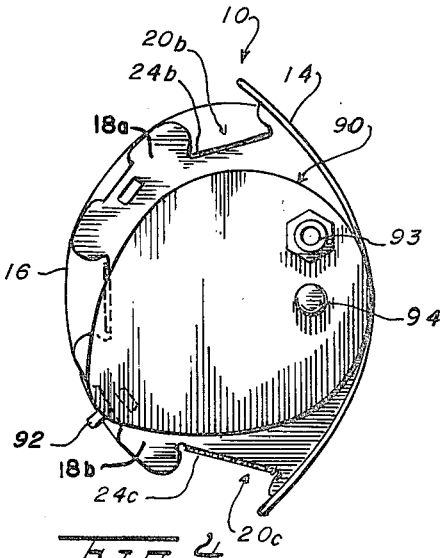
FIG. 4 is a right end view thereof.
Figure 5:
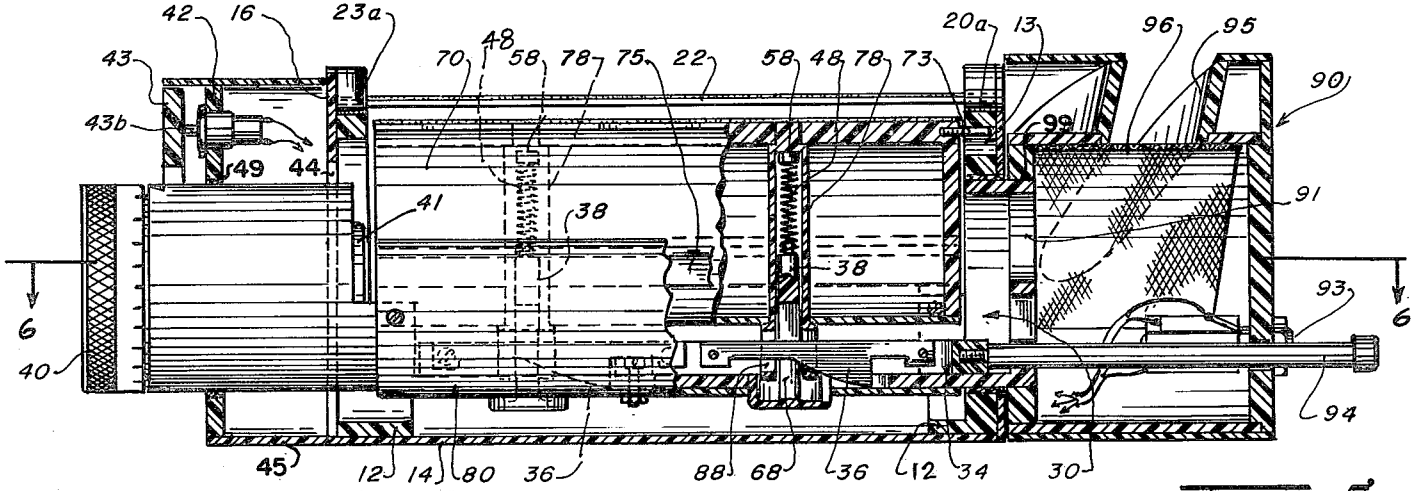
FIG. 5 is a sectional view along line 5—5 of FIG. 1 with cutaway parts for clarity.
Figure 6:
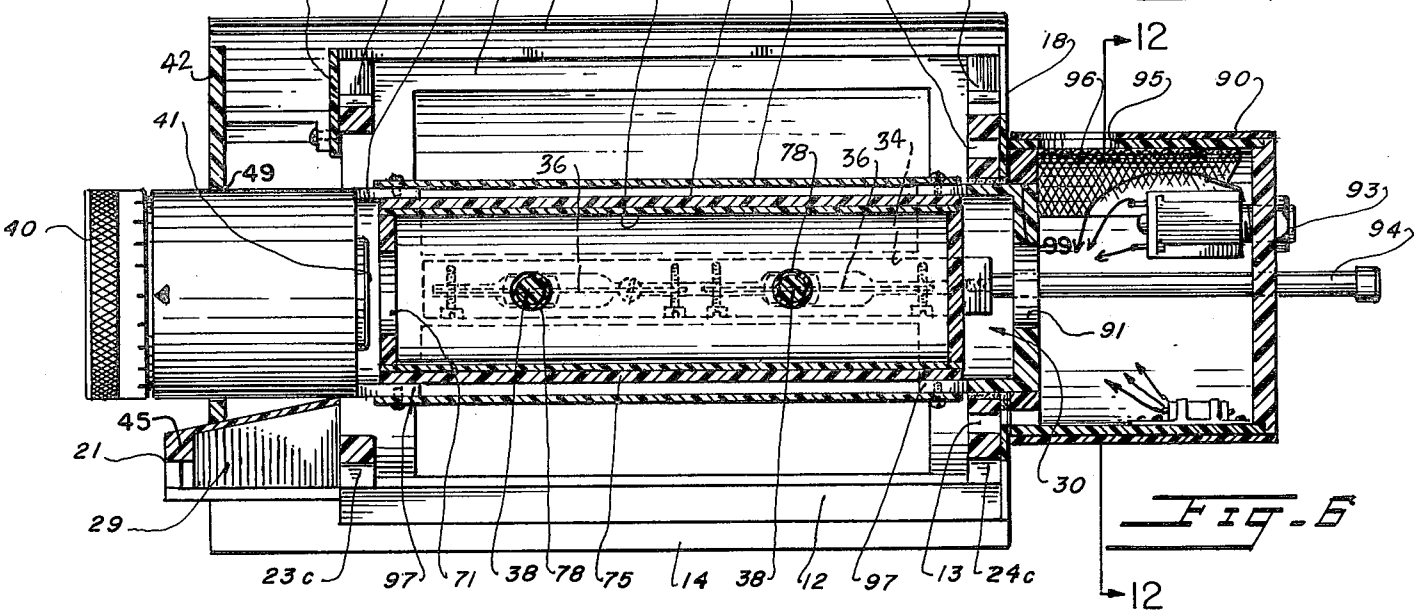
FIG. 6 is a section view along line 6—6 of FIG. 5.
Figure 7:
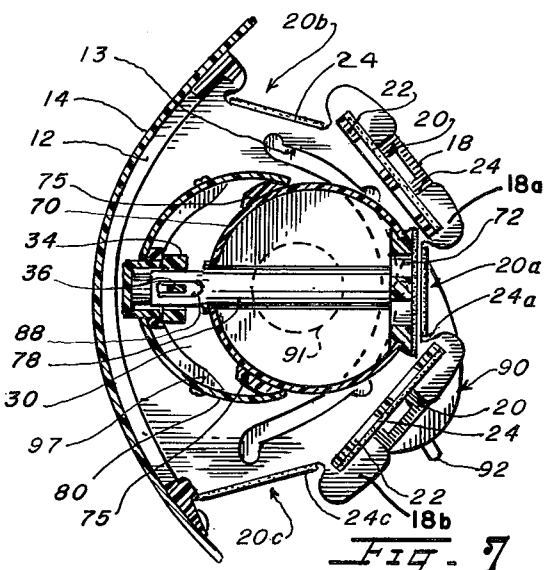
FIG. 7 is a section view along ine 7—7 of FIG. 1.
Figure 8:
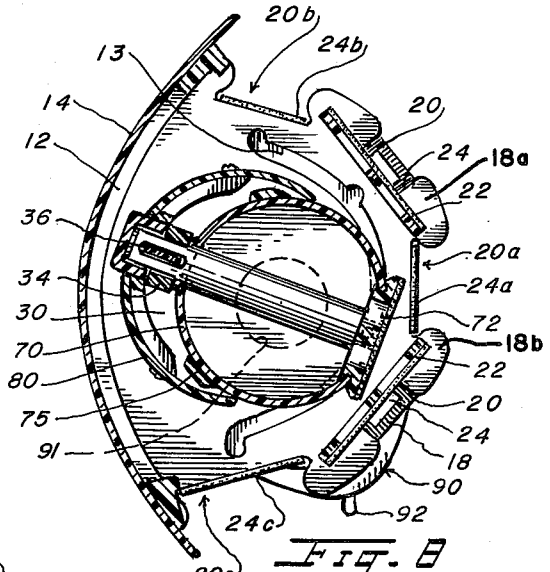
FIG. 8 is the same view as in FIG. 7 but with a rotational interchange between harmonicas being effected.
Figure 11:
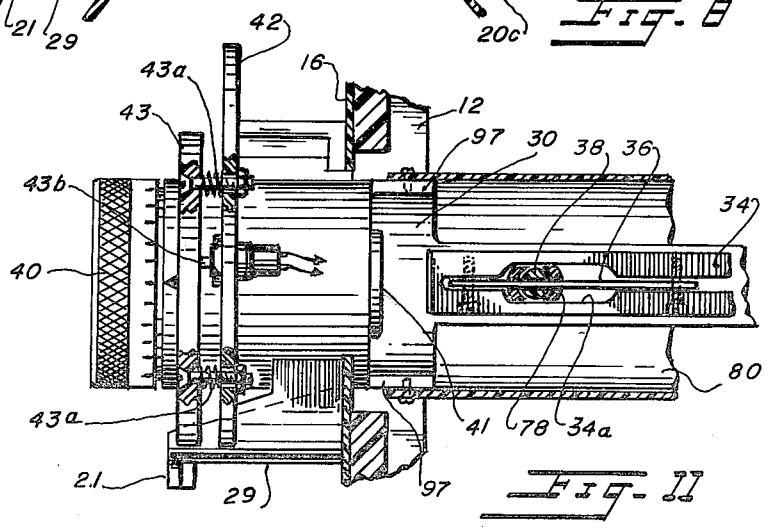
FIG. 11 is a plan partial section of the left end of the electric mouth organ holder.
Figure 9:
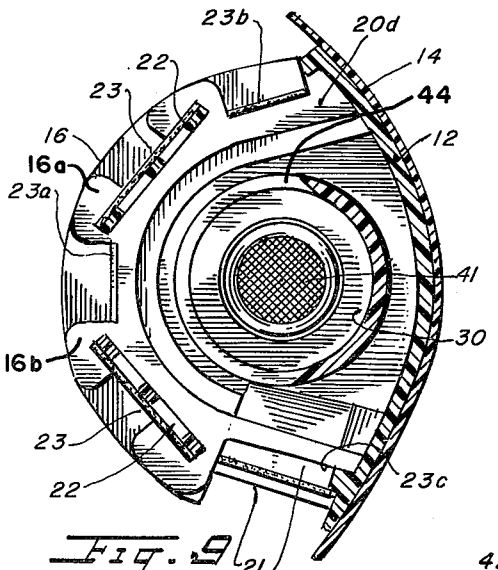
FIG. 9 is a section view along 9—9 of FIG. 1.
Figure 10:
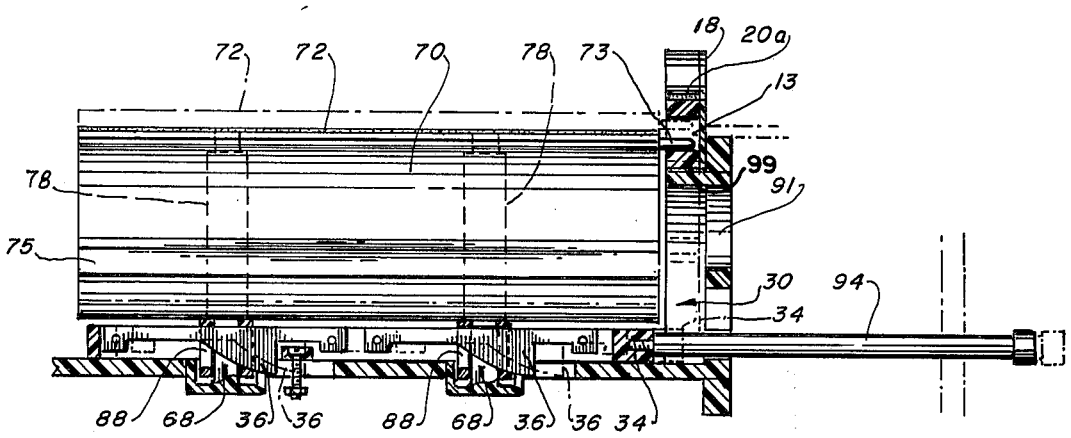
FIG. 10 is a partial elevation sectional view of the central sound collecting cylinder with vertical movement control means.

With specific reference to the drawings, FIG. 1 depicts the electric mouth organ holder 10 of the present invention with the preferred sound control means 90. Mouth organ holder 10 comprises outer shell 12, the exterior of which contains holding means which supports up to five harmonicas and comprises slots 20,20*a*, 20*b* and 20*c*. Slot 20*c* additionally includes a special longer accomodation for a four octave chromatic harmonica. It is preferred that the electric mouth organ of the present invention contain no more than five harmonicas in order for the electric mouth organ to be both compact and allow for practical utilization of each of the harmonicas with sufficient room being available between individual harmonicas to permit room for the player's face, particularly the nose. Generally, three widely spaced harmonicas of varying types are sufficient for use in most songs. Outer shell 12 comprises a rectangular framework 11, more clearly seen in phantom in FIG. 2. Curved sheet 14 (FIGS. 1–4) is attached to one side of rectangular framework 11 to generally provide structural strength. Plate members 16 and 18 are set at right angles to the sheet 14 and the rectangular framework 11 at the ends of said framework to provide end walls for the outer shell 12. Open grid members 22 span the open area between end plate members 16 and 18 and connect such plate members to provide further structural strength to the outer shell 12. Grid members 22 are covered with sponge for moisture retention. The exposed upper edge of end plate member 18 comprises indented eared sections 18*a* and 18*b* (FIGS. 4,7, and 8) which accommodate, hold and support one end of the flared bottoms of standard harmonicas therebetween or between the eared sections 18*a* and 18*b* respectively and curved sheet 14. Slots 20*a*, 20*b*, and 20*c* slidingly receive harmonicas with the harmonicas in slots 20*a* and 20*b* being stopped into position by portions of end plate member 16. Eared sections 16*a* and 16*b* on the interior of end plate member 16, shaped to correspond to eared sections 18*a* and 18*b* respectively, accommodate, hold and support the other end of said harmonicas therebetween or between such eared sections 16*a* and 16*b* respectively and curved sheet 14. Harmonicas positioned within slots 20*b* and 20*c* are thereby supported laterally on one side by the ends of curved sheet 14 (FIG. 4).

Figure 14:
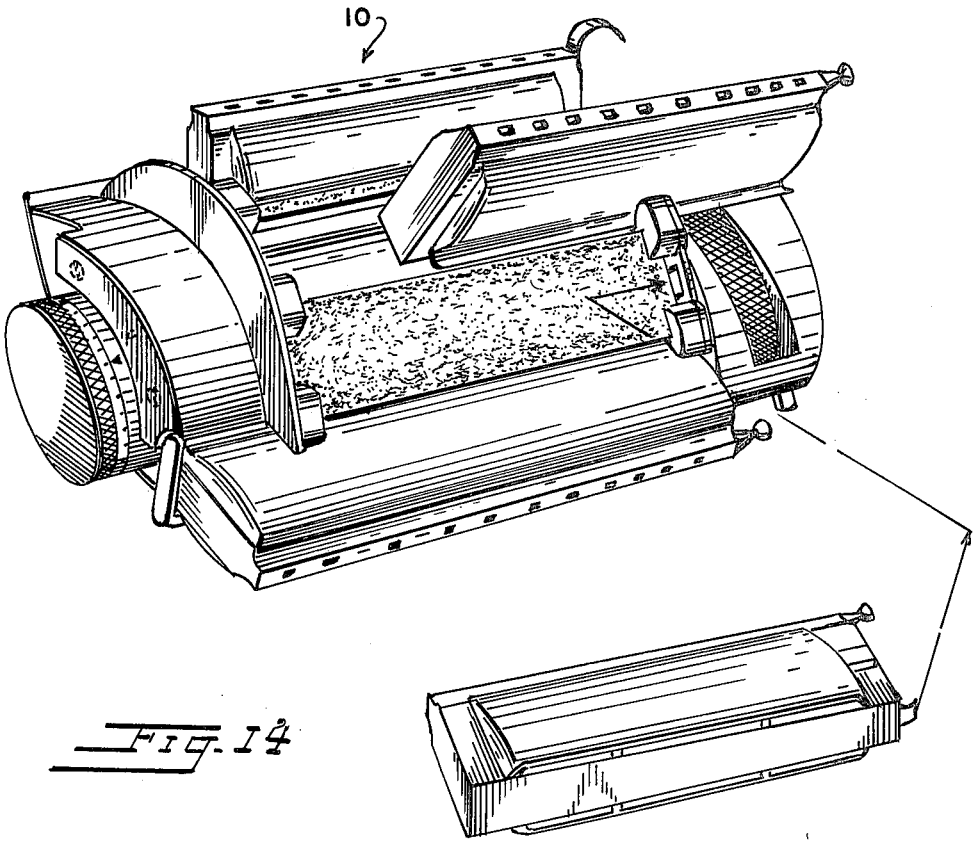
FIG. 14 is an isometric view of the electric mouth organ holder with harmonicas being individually placed thereon.

In order to accommodate the larger four octave chromatic harmonica, slot 20*c* extends beyond end plate 16 which is cut to allow for such extension. The end of the four octave harmonica is stopped by member 21 in extension portion 45. The end of the four octave harmonica extending beyond end plate 16 is acoustically interconnected with the interior of shell 12 via inclined ramp 29. Slots 20 are sized to accommodate harmonicas with a snap in rather than a sliding engagement. The distances between eared sections 18*a*, 18*b* and corresponding sections 16*a* and 16*b* which define slots 20 are accordingly predetermined to snugly hold standard sized harmonicas therebetween with a frictional engagement. Additionally, as more clearly seen in FIG. 14, slots in eared sections 18*a* and 18*b* hold extending tabs on the base of standard connected harmonicas.

The harmonicas are held as described in rotatable relation to a central core section 30 which includes a sound collecting means 70 (more clearly shown in FIGS. 5,6,10 and 13). The sound collecting means 70 comprises a generally hollow cylinder having a portion of a side wall thereof open and covered with open grid 72 (with a sponge cover thereon) corresponding in size and open configuration to the base of a standard harmonica. The cylinder also has an aperture 71 at an end wall thereof. The sound collector 70 collects sound from the base of an adjacent harmonica through the open grid 72 of said sound collector 70 for eventual amplification by microphone 41 adjacent an end of said shell 12 (FIGS. 5,6,9 and 11). Microphone volume control 40 and leslie or phaser control 43*b* at the left of outer shell 12 provides sound control with the volume control controlling the loudness of the amplified sound and the leslie or phaser control 43*b* providing a wavering tone sound effect for such sound. Wall 42 parallel to and spaced from end wall 16 supports leslie control 43*b*. Spring loaded screws 43 connect elongated leslie switch member 43 in position whereby the leslie control 43*b* is actuated by depression of switch member 43. Sound from the played harmonica carries from sound collector 70 through aperture 71 in the sound collector to sound control chamber 90 via split tubular sound channeler 80 to aperture 91 in the sound control chamber. Sound control opening 95 in a wall of sound control chamber 90 with protective screen 96 is adapted to be closed by a finger and provides selective "wah" "wah" and vibrato sound effects by vertical movement of such finger. Split tubular sound channeler 80 thereafter directs sound from the sound control chamber 90 to the microphone 41. Electric current and external connection to an amplifier apparatus is carried by conductive cables plugged into jack 93 on chamber 90 and electric switch 92 on chamber 90 turns the amplification and electrical controls of the mouth organ on or off, FIG. 12.

With reference to FIGS. 5,6,10 and 13, the central core section 30 is shown as being positioned with its longitudinal axis along the longitudinal axis of the generally cylindrical outer shell 12. The central core section 30, in the preferred embodiment, as shown, comprises a tube which extends through apertures 99, 49 and 44 in end walls 18, 42 and 16 respectively. As shown, the left end of the core section 30 contains microphone 41 and adjacent volume control 40. The right end of core section 30 extends slightly beyond end wall 18 and is peripherally gripped with a frictional grip by the walls of aperture 99 of sound control chamber 90.

Figure 13:
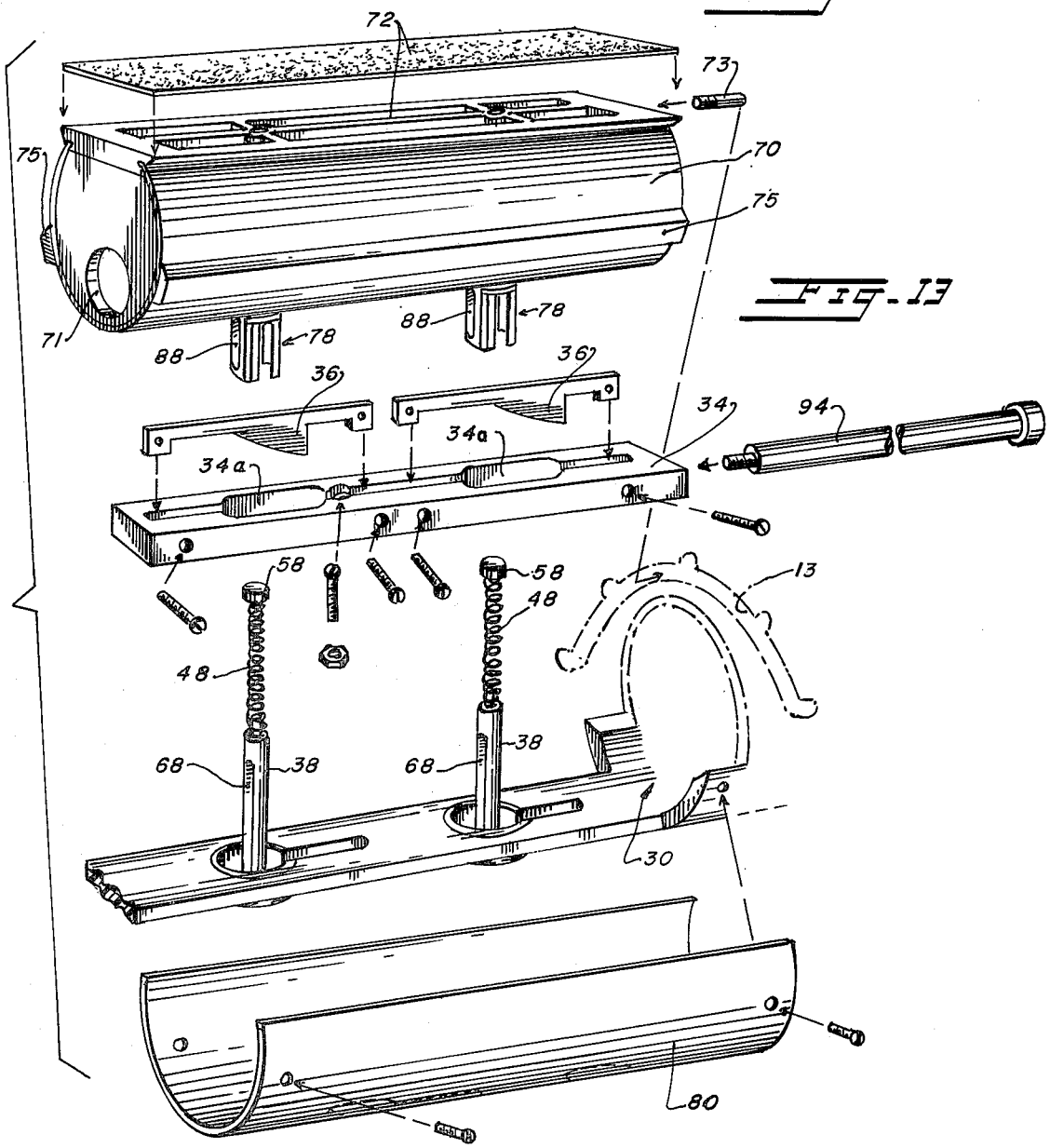
FIG. 13 is an exploded view of the central sound collecting cylinder and sound channeler with movement control means.

In the interior of shell 12 a portion of the tube of the central core section 30 is cut away, as shown in FIG. 13 to provide a planar platform for cylindrical sound collector 70. The sound collector 70 is further nested within split tubular sound channeler 80 with the sound collector being supported and attached above the planar platform of the core section 30 and the split tubular sound channeler 80 being supported and attached below said planar platform. As more clearly seen in FIGS. 7 and 8, longitudinal runners 75 on sound collector 70 further hold split tubular section 80 in position with an acoustical seal when collector 70 is adjacent a harmonica. Slotted upright posts 38 extend from said planar platform and contain spring members 48 with caps 58. Posts 38 with springs 48 fit within corresponding slotted members 78 attached to sound collector 70 such that slots 88 of slotted members 78 coincide with slots 68 of posts 38 and wherein springs 48 are compressed thereby to provide upward spring tension. Counteracting the spring tension are key or cam members 36 inserted through the aligned slots 68 of the upright posts 38 and the slots 88 of the corresponding members 78 on the sound collector 70. The key or cam members 36 (one for each upright post 38) are fixedly secured within cavities 34*a* of sliding runner 34 by transverse screws as shown. Sliding runner 34 is in turn supported by the planar section of the cutaway portion of central core section 30. The slide runner 34 is movable along the longitudinal axis of the outer shell 12 and the central core section 30. Such movement is controlled by control rod 94 extending from an end of slide runner 34 to the outside of the mouth organ 10. Upon inward movement of the control rod 94 and the slide runner, the fixed fin sections of the key or cam members 36 engage the lower terminal of the slots 88 in slotted members 78 of the sound collector 30. Upon further movement force, such slotted members 78 and the sound collector 30 are forced downward whereby the sound collector may be freely rotated for acoustic engagement with another harmonica. Upon rotation and selection of an appropriate harmonica the control rod 94 is released with the sound collector being raised thereby by the spring tension previously described. Relatively close contact is thereby achieved and maintained between harmonica and sound collector with minimal sound leakage. To ensure proper alignment, track 13 in end wall 18 accommodates guide pin 73 in sound collector 70 whereby said sound collector follows a predetermined path. Track 13 contains indented stations or stops positioned therein whereby proper engagement of the desired harmonica with the sound collector 70 causes the guide pin 73 to fall into and be held by one of said stops. Disengagement of the guide pin 73 and in turn the sound collector 70 is effected by a downward motion controlled by control rod 94 as above described. The cross sectional views of FIG. 7 and 8 more clearly indicate the engagement and disengagement of sound collector 70 whereby it may be freely rotated as desired.

During operation of the electric mouth organ, collected sound emanates from aperture 71 in sound collector 70 and is partially directed to aperture 91 in the sound control chamber 90. Digital manipulation of aperture 95 by raising or lowering a finger or cupping of the entire hand thereon simulates the cupping effect, previously described, in conjunction with individually utilized harmonicas thereby producing either "wah" "wah" or vibrato effects. The sound from the sound control chamber 90 is thereafter routed or channeled to the microphone 41 for amplification and if desired, the utilization of the leslie or phaser by means of control 43*b* for further sound effects directly within the amplification system. Split tubular member 80 which functions as a sound channeler between the sound control chamber 90 and the microphone 41, is located slightly below the plane of the sound collector 70 and is positioned in alignment with microphone 41 and aperture 91 organ.

Figure 12:
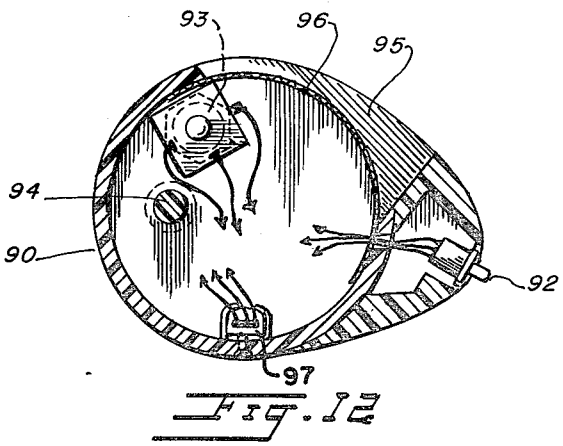
FIG. 12 is a sectional inside end view of the sound control chamber along line 12—12 of FIG 6.
Figure 16:
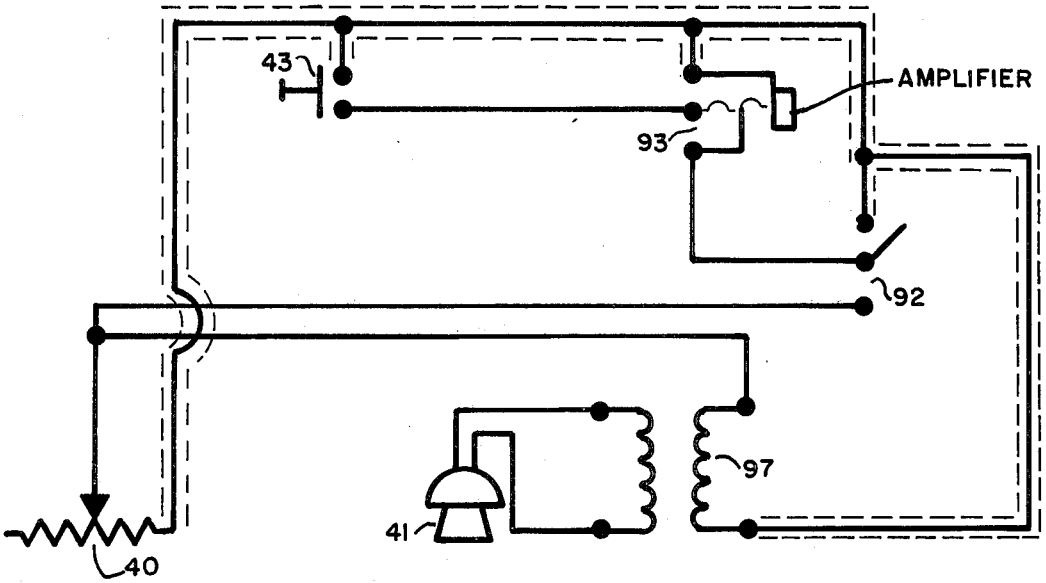
FIG. 16 is a circuit diagram of the electronics of the preferred embodiment of the present invention.

With respect to the electronics of the amplification and the sound control system, sound control chamber 90 contains on/off switch 92 and three terminal jack 93. Jack 93 provides current for the operation of the electric mouth organ and further provides connection between the microphone 41, and an external amplifier and speaker. At the other end of the electric mouth organ are microphone 41, leslie or phaser control switch 43*b* and potentiometer or volume control 40. The interrelation of the various electrical components is schematically shown in FIG. 16. The connecting wires from the microphone, leslie and volume control are preferably routed beneath the sound collector and split tubular section for connection as shown in FIG. 12 including connection with transformer 97.

During operation of the electric mouth organ 10, the mouth organ is held with both hands of the operator arranged such that the left index finger may rotate volume control 40 and the left thumb depresses leslie or phaser extension switch member 43. As seen in FIGS. 3 and 4 the electric mouth organ is generally ovate in cross section whereby it may be comfortably cradled in the operator's hands. The right thumb of the operator controls the on/off switch 92. The right index finger controls the half note slide bar of the standard harmonica being played. The right middle finger is positioned on sound control aperture 95 with the finger being lifted to provide a "wah" "wah" or vibrato effect. The palm of the right hand pushes control rod 94 inwardly when a change of harmonicas is desired whereby the sound collector 70 may be rotated relative to shell 12 which supports the harmonicas and the control rod 94 is held inwardly while such rotation is effected.

Figure 15:
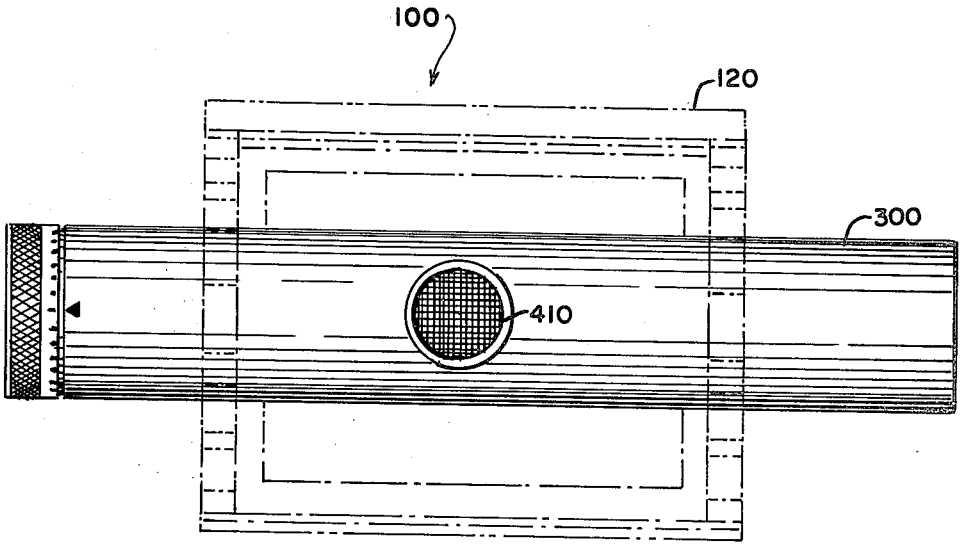
FIG. 15 is a schematic of a second embodiment of the present invention.

FIG. 15 schematically depicts a simplified version of the electric mouth organ of the present invention. Mouth organ 100 comprises a framework or shell 120 for supporting multiple harmonicas similar to shell 12 of the mouth organ 10 in FIG. 1. In place of both the sound control chamber 90 and the sound collector 70 with split tubular sound channeler 80 is a straight cylinder 300 containing the microphone 410 for direct juxtaposition with the desired harmonicas. In the embodiment shown in FIG. 15, sound effects engendered by a leslie or phaser may still be utilized since such control is relative to the amplification and not to the sound prior to amplification. The embodiment shown in FIG. 15 while not providing the additional sound capability of the embodiment shown in FIG. 1, nevertheless provides a more open sound because of the direct proximity of microphone to harmonica.

Figure 17:
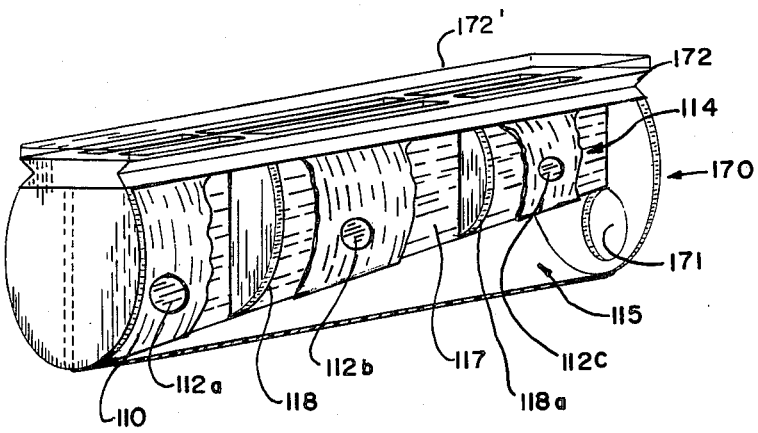
FIG. 17 is an isometric sectional view of a second embodiment of the central sound collecting cylinder.

Further modifications of the sound collecting means are possible as seen in FIG. 17 wherein in place of the hollow cylindrical configuration of the sound collector 70 as in FIG. 13, the sound collector 170 further contains therein a diagonal perforated partial conical section 110. The diagonal conical section 110 effectively divides the sound collector into two portions, an upper portion 114 adjacent the base of the harmonica and a lower portion 115 having an aperture 171 therein adjacent the sound control means. The reduced depth area of the upper portion 114 of the sound collector is positioned adjacent the high note segment of the standard harmonicas used therewith and the greater depth area of the upper portion 115 of the sound collector is adjacent the low note segment of standard harmonicas. Perforations 112*a–c* (112*d–f* not shown) in the diagonal conical section 110 provide for sound transfer between the upper and lower portions 114 and 115 of the sound collector 170 and thereafter to the sound control chamber. In addition to the diagonal sectioning, the upper portion may be segmented into a number of vertical chambers up to the corresponding number of holes at the base of the harmonicas utilized therewith. The segmentation of the sound collector as described serves to further separate and enrich the sound prior to amplification. Because of the remoteness of the microphone from the harmonicas in the sound control embodiment such enrichment may be necessitated. As shown, the upper portion 114 is longitudinally bisected by partition 117 perpendicular to the open portion of the sound collector and transversely trisected by discs 118 and 118*a* to provide six chambers which has been found to be adequate for such enrichment.

The harmonica interchange mechanism shown in FIG. 13 may be simplified by fixedly anchoring the sound collector on the rotatable platform adjacent grids 22 and providing the peripheral edges of the grid 72 on sound collector 70 with pliant plastic strips whereby rotatable engagement between sound collector 70 and the grids 22 provides a substantially sealed arrangement. Interchange between harmonicas does not require the raising and lowering mechanism of FIG. 13 but can be effected by simple rotation with sealing engagement between pliant plastic strips of the sound collector 70 and the grids 22 of the outer framework 12. In such embodiment in place of the track 13 with pin 73, spring loaded fingers with a disengaging lever may be included on the rotatable sound control chamber which fingers fit into apertures on plate member 18 when properly positioned.

A further modification particularly with the divided sound collector of FIG. 17 includes physical placement of the microphone within the sound control chamber whereby the microphone is spaced from the sound collector such that the area of the sound control chamber directly below the finger control intervenes between the sound collector and the microphone. In this embodiment the sound collector contains an aperture 171 equivalent to 71 in FIG. 13 adjacent the sound control chamber. By placing the finger control of the sound control chamber between the sound collector and the microphone it is therefore possible to fully control and modify substantially all of the sound emanating from the harmonicas.

These and other modifications in structure and positioning of the mouth organ components may be effected without departing from the scope of the present invention as defined in the following claims.

What is claimed is:

1. An electric mouth organ holder comprising a first member having means thereon for holding a plurality of harmonicas; a second member held in movable relation to said first member; means on said holder for holding a single microphone; and said microphone, wherein said second member collects sound emitted from said harmonicas individually and wherein any individual harmonica, when held by said first member may be selectively and exclusively positioned and positively engaged acoustically adjacent said second member, with said second member being interposed between said selected harmonica and said microphone to direct sound from said selected harmonica to said microphone, said holder further containing means for manually altering sound emitted from said selected harmonica in the acoustic path between said selected harmonica and said microphone whereby said emitted sound is altered prior to pickup thereof by said microphone.

2. The electric mouth organ holder of claim 1 wherein said first member comprises a generally cylindrical frame having end walls with apertures therein and wherein said second member comprises a core for said first member, said second member interiorally longitudinally spanning said first member and extending through said apertures with said second member and said first member being in rotatable relation with each other.

3. The electric mouth organ holder of claim 2 wherein said microphone holding means is on said second member.

4. The electric mouth organ holder of claim 2 wherein said holder further includes means for directing said collected sound to said means for altering sound prior to pickup of said sound by said microphone.

5. The electric mouth organ holder of claim 4 wherein said second member comprises a cylinder having a portion of a wall thereof open and said open wall portion being sealingly juxtaposed adjacent a base of a selected harmonica, said cylinder further having an aperture in an end wall thereof whereby said aperture comprises said means for directing sound to said means for altering sound.

6. The electric mouth organ holder of claim 5 wherein said cylinder is diagonally divided into two parts by a conical section having an open side thereof coinciding with said open portion of the wall of said cylinder, and wherein said cylinder within said conical section, is longitudinally divided by a partition within said conical section, said partition being disposed perpendicularly relative to said open portion of said wall, said conical section being further axially sectioned by one or more discs to form chambers within said conical section and wherein said conical section comprises at least one aperture therein adjacent each of said chambers.

7. The electric mouth organ holder of claim 1 wherein said electric mouth organ holder further includes control means for a phaser thereon with said phaser altering said sound after pickup thereof by said microphone.

8. The electric mouth organ holder of claim 4 wherein said means for altering sound comprises a cylinder positioned adjacent said second member and acoustically connected therewith, said means for altering sound further comprising an aperture on a wall thereof, said aperture being accessible for opening and closing whereby sound contained within said cylinder is altered thereby.

9. The electric mouth organ holder of claim 5 wherein said electric mouth organ holder further includes means for fixedly engaging and means for disengaging said harmonicas from said adjacently juxtaposed position relative to said open wall portion of said sound collecting cylinder.

10. The electric mouth organ holder of claim 9 wherein said engaging means comprises spring members on said second member which exert a spring tension between said sound collecting second member and said harmonica.

11. The electric mouth organ holder of claim 10 wherein said sound collecting second member further includes slotted members extending therefrom and wherein movable cam members on said second member fit within said slotted members whereby movement of said cam members forces disengagement of said sound collecting second member from said harmonica against said spring tension.

12. The electric mouth organ holder of claim 11 wherein said engaging means further comprises a guide pin on said sound collecting second member movable within a track having stops therein wherein said spring tension causes said pin to fall within said stop to provide for said engagement of said harmonica and said sound collecting second member.

13. The electric mouth organ holder of claim 9 wherein said engaging means comprises spring loaded finger members and corresponding apertures therefore.

14. The electric mouth organ holder of claim 2 wherein said means for holding said harmonicas comprises said end walls of said generally cylindrical frame with said harmonicas being frictionally held therebetween.

15. The electric mouth organ holder of claim 2 wherein said means for holding said harmonicas comprises guide members on the exterior of said cylindrical member adapted to slidingly receive flared bottoms of said harmonicas.

16. The electric mouth organ holder of claim 5 wherein said open wall portion has a pliant plastic member on the periphery thereof to provide said sealing juxtaposition with said harmonica.

17. The electric mouth organ holder of claim 8 wherein said microphone is contained within said cylinder with said aperture adjacently between said sound collecting second member and said microphone.

18. An electric mouth organ holder comprising a first member, having means thereon for holding a plurality of harmonicas, comprising a generally cylindrical frame having end walls with apertures therein; and a second member held in movable relation to said first member and comprising a core for said first member, said second member interiorally longitudinally spanning said first member and extending through said apertures with said second member and said first member being in rotatable relation with each other and wherein said second member has a microphone thereon whereby rotation of said second member relative to said first member selectively positions said microphone directly adjacent one of said harmonicas whereby sound emitted from said selected harmonica is directly picked up by said microphone.

* * * * *